United States Patent [19]

Okuma et al.

[11] 3,994,366

[45] Nov. 30, 1976

[54] SLIP DOWN WAY EMBARKING DEVICE

[75] Inventors: Masahiro Okuma, Shiraoka; Mutuo Sato, Urawa; Matuo Narita, Ohmiya; Toshio Sugimoto, Okegawa; Masahumi Isihara, Ohmiya; Hisanao Yagi, Tokyo, all of Japan

[73] Assignee: Fujikura Rubber Works Limited, Tokyo, Japan

[22] Filed: Nov. 1, 1974

[21] Appl. No.: 520,039

[30] Foreign Application Priority Data

| | | |
|---|---|---|
| Dec. 27, 1973 | Japan | 49-4679[U] |
| Nov. 8, 1973 | Japan | 48-124947 |
| Nov. 12, 1973 | Japan | 48-130482[U] |
| Nov. 7, 1973 | Japan | 48-128920[U] |
| Nov. 7, 1973 | Japan | 48-128921[U] |
| Nov. 13, 1973 | Japan | 48-130402[U] |
| Nov. 12, 1973 | Japan | 48-130483[U] |
| Nov. 7, 1973 | Japan | 48-128919[U] |
| Nov. 7, 1973 | Japan | 48-128918[U] |
| Mar. 27, 1974 | Japan | 49-34600[U] |
| Mar. 27, 1974 | Japan | 49-34661[U] |

[52] U.S. Cl. ..... 182/48; 182/70; 193/25 R

[51] Int. Cl.[2] ..... A62B 1/20

[58] Field of Search ..... 182/48, 49, 74, 70; 193/25 R, 25 A

[56] References Cited

UNITED STATES PATENTS

| | | | |
|---|---|---|---|
| 486,357 | 11/1892 | Settle | 193/25 R |
| 1,123,029 | 12/1914 | Smith | 182/70 |
| 2,101,284 | 12/1937 | Simpson | 182/48 |
| 2,210,182 | 8/1940 | Schultz | 182/74 |
| 2,901,055 | 8/1959 | Fairchilds | 182/49 |
| 2,955,299 | 10/1960 | Ingram | 182/48 |
| 3,433,323 | 3/1969 | Ukawa | 182/48 |
| 3,819,011 | 6/1974 | Kinase | 182/48 |

*Primary Examiner*—Reinaldo P. Machado
*Attorney, Agent, or Firm*—Lerner, David, Littenberg & Samuel

[57] ABSTRACT

A novel slip down way embarking device used in an emergency of a ship or other constructions to transfer the passengers to a life raft or other life saving apparatus in safe and rapid manner, said device comprising a tubular slip down chute made of vertical elongated cloth, a zigzag passage formed within said chute, a slip way attached to the lowermost end of said zigzag passage, a floating platform positioned under said chute and slip way to receiver the slipped down persons thereon, and a container to store the above embarking members and throw them down in an emergency without trouble and difficulty.

26 Claims, 35 Drawing Figures

FIG. 8
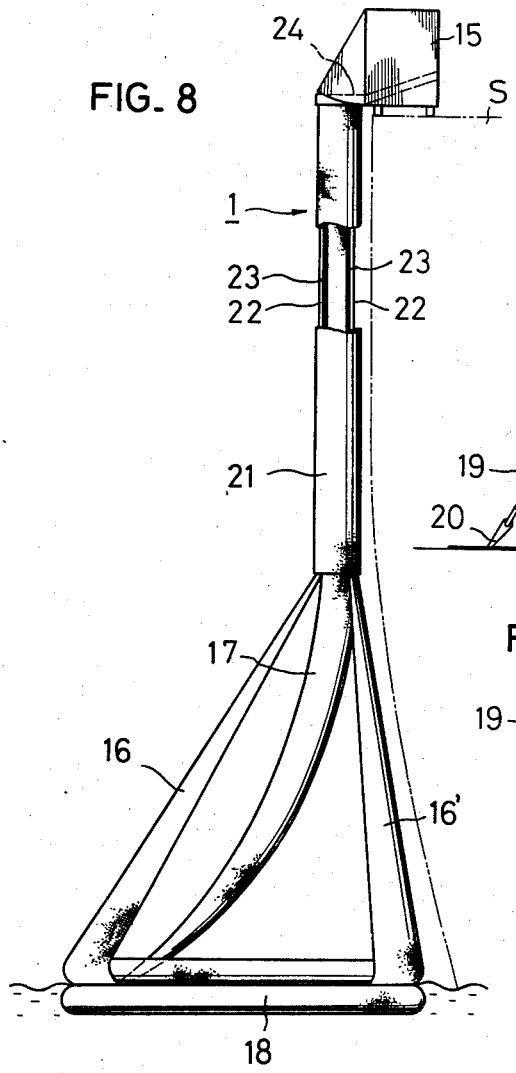
FIG. 9
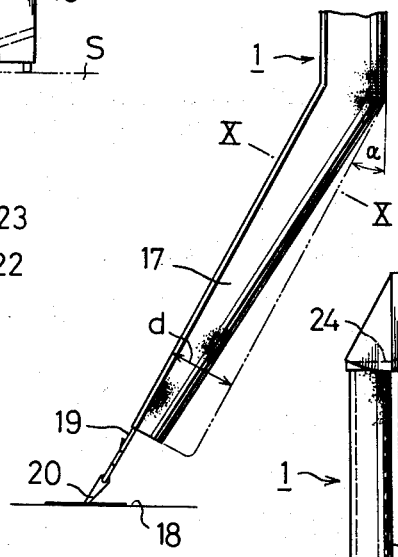
FIG. 10
FIG. 11
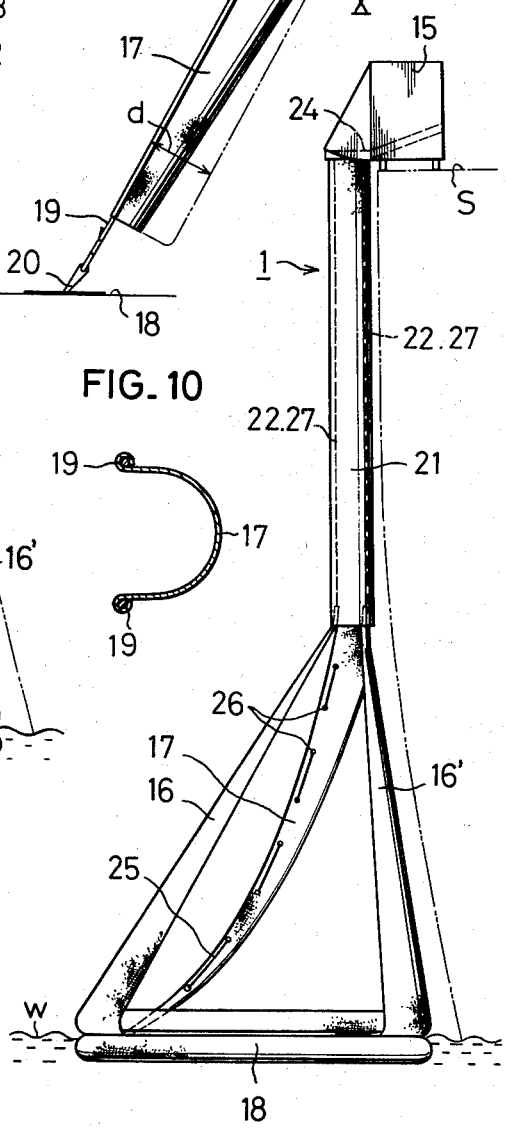

FIG. 16
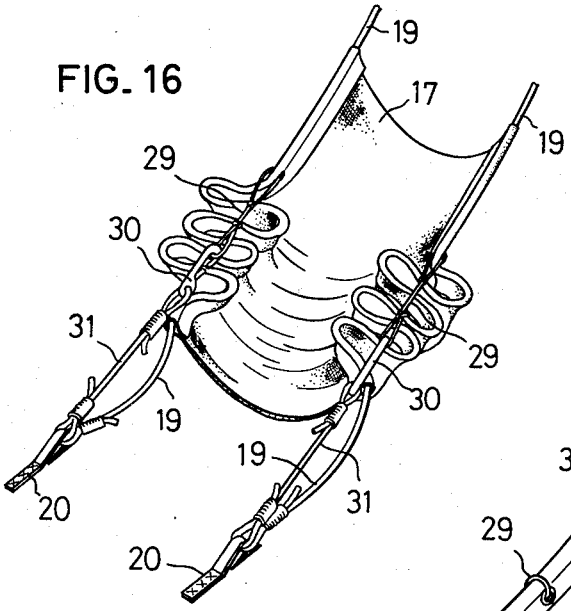
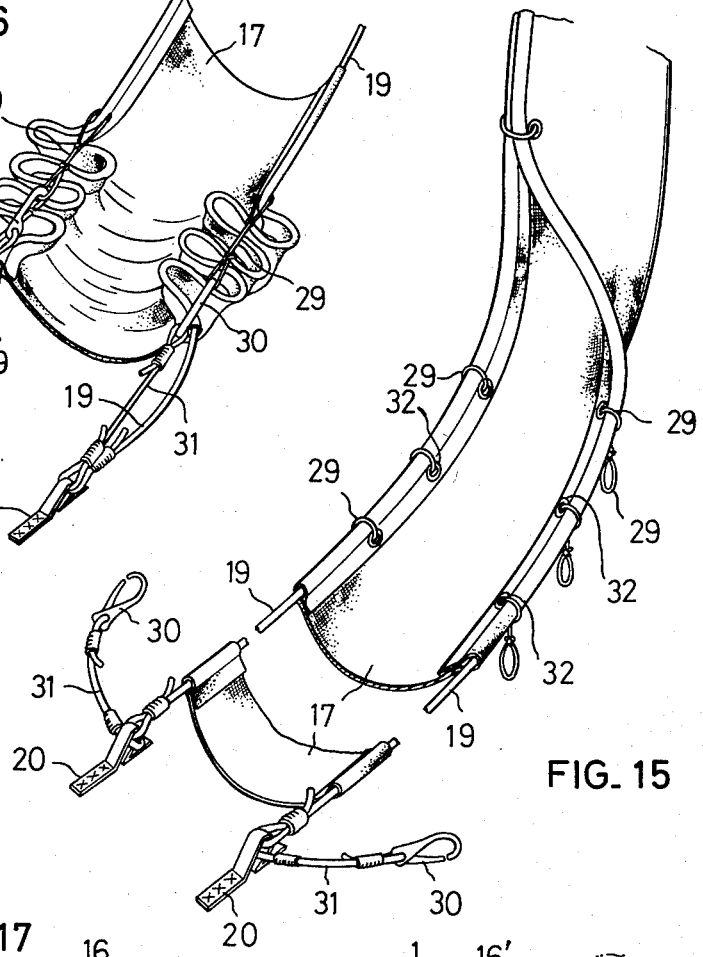
FIG. 15
FIG. 17
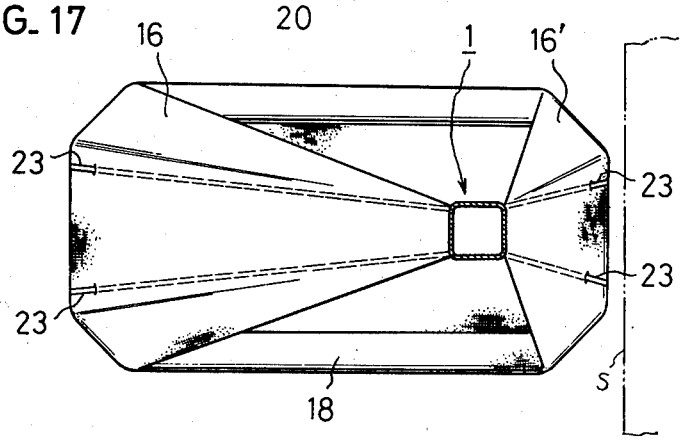

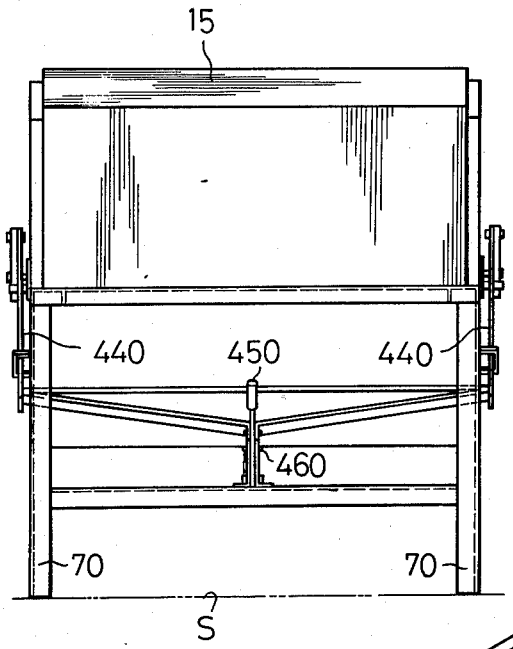
FIG. 26
FIG. 25
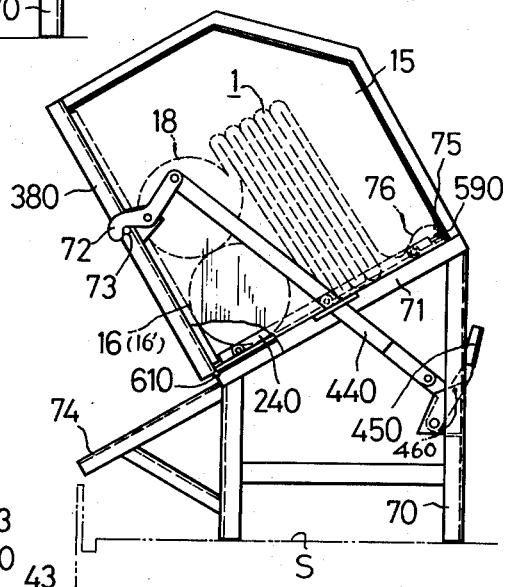
FIG. 24
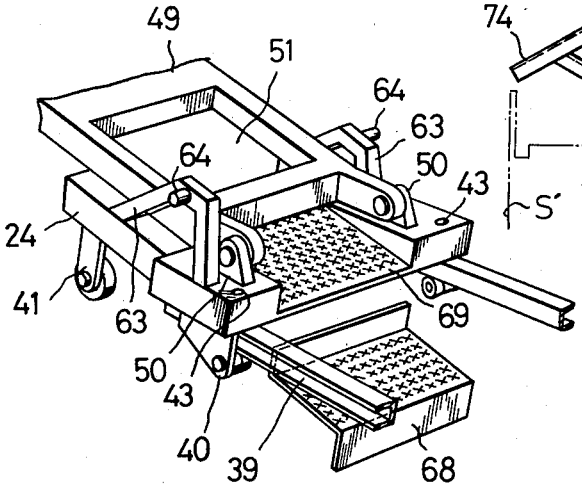

SLIP DOWN WAY EMBARKING DEVICE

BACKGROUND OF THE INVENTION

This invention relates to a slip down way embarking device for motor ships which is used for quickly and safely accommodating all passengers on board to life rafts or the like when an accident such as a fire is caused.

Due to the recent increase of large-sized ships, the freeboard (the distance between the load line and the upper deck) has generallly become high such as about 10 to 20 meters. Therefore, in case of emergency, it is dangerous to jump down directly to an inflated life raft on the sea surface, and further, it is difficult to transfer the inexperienced passengers in safe and quick manner to a life raft by using a rope ladder or a net.

BRIEF SUMMARY OF THE INVENTION

In view of the above, the inventors of the present application have developed a novel embarking device. In an emergency, a slip down chute is suspended from the upper deck to the broadside of the ship and a floating platform is furnished to the lower end of said chute, by which the passengers on board can be transferred safely and rapidly to said platform. In order to modify or slow down the slipping down of the survivor within the tubular chute, it is proposed that the chute is provided with a zigzag passage therein and a slip way at the lowermost end of said chute, further, a floating platform is releasably provided under said chute and slip way. After the passengers have slipped down, the floating platform may be released from the slip down chute to drift away, or the passengers, i.e. survivors on the platform are transferred to other life raft which has been inflated separately, thereby a safe and quick refuge can be carried out. Accordingly, the principal object of the present invention is to propose such slip down way embarking device.

In the prior art, the slip down chute of this kind has been only a simple tube, so that the slip down velocities have been different in connection with the sizes and weights of the persons such as a person wearing a life jacket, a tall adult without such jacket, a fat man and a child. Considering the above fact, the tubular chute of the present invention is provided with a zigzag passage in order to keep the slipping down velocity in a certain safe range.

Further, in the present invention, protective curtains are attached between the lower portion of slip down chute and the floating platform under said chute in order to prevent the survivors from falling into the sea or colliding against the broadside of the ship by the movement of the platform, and further, the inclined slip way attached to the lower end of said chute can be regulated in its inclination angle.

BRIEF DESCRIPTION OF THE DRAWINGS

These and other features of the present invention will be more fully understood by referring to the following detailed description presented solely for purpose of illustration and to the accompanying drawings in which:

FIG. 8 is a side view of an embodiment in which a slip way is attached between the canvas chute and a floating platform;

FIG. 9 is an enlarged side view of said slip way;

FIG. 10 is a cross-sectional view of said slip way taken along the line X—X in FIG. 9;

FIGS. 11 and 12 are explanatory side views of the embarking device for illustrating the regulation of the level of said platform in compliance with the change of sea surface level;

FIG. 15 and 16 are explanatory perspective views of the slip way illustrating the regulation of length thereof;

FIG. 17 is a plan view of said floating platform;

FIG. 24 is a perspective view of steps at the entrance;

FIGS. 25 is a side view of another embodiment of the device as shown in FIG. 22;

FIG. 26 is a rear view of the device as shown in FIG. 25;

DETAILED DESCRIPTION OF THE INVENTION

Figure 1:
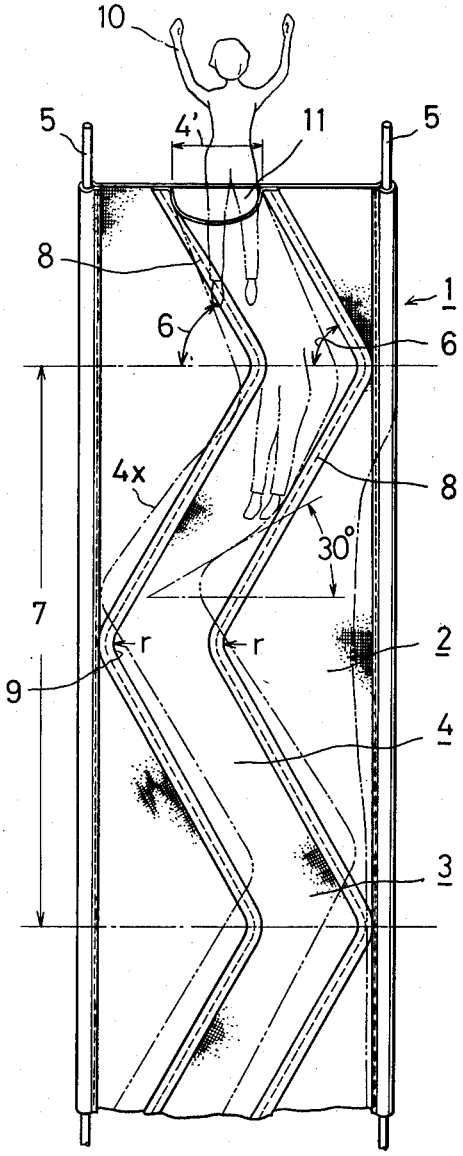
FIG. 1 is a perspective view of the main portion of a life saving canvas chute in the present invention.

Referring now to the drawings, especially to FIG. 1, the slip down chute 1 of the present invention comprises a base cloth 2 and a passage cloth 3 which is sewn longitudinally to the surface of said base cloth 2 to form a tubular zigzag passage 4. Said base cloth 2 and passage cloth 3 may be made of natural or synthetic fiber cloth such as canvas which having substantial strength and thickness, and treated with waterproof agent, heat resisting agent, antistatic agent and the like. The base cloth 2 is a single sheet which is about 30% wider than the maximum circumferential length (about 2 m or less) of a man to be passed, and the both sides are provided with reinforcing ropes 5. The zigzag passage 4 is inclined with a zigzag angle 6 in the range of 60° ± 10° to the horizontal plane so as to provide a safe slipping down velocity, and the pitch 7 is generally 1.2 m to 2 m. The passage cloth 3 of this zigzag passage 4 is sewn to the base cloth 2 at the seams 8, and the portion 9 of zigzag passage 4 which approaching the reinforcing rope 5 has a radius of curvature *r* smaller than the width 4' of the passage, so that when the leg portion of a man passes through, the bent portion 9 facilitates the direction change through the passage 4 in cooperation with the inhibitory action of partial expansive deformation by the reinforcing rope 5. Further it relieves the resistance of slipping down, thereby the resistance through the zigzag passage can be made smooth.

The girth of the zigzag passage 4 is made properly larger than the expected maximum size so as to facilitate the passage of even thickly clad body wearing life jacket or the like, therefore the girth of this zigzag passage may be about 1.8 to 2 m.

As explained in the foregoing, cloth having a sufficient width is used for the base cloth 2, while cloth of 1 m in width is generally used as it is for the passage cloth 3 so as to prevent the occurrence of damage of the same caused by the contact with the leg portion of the person 10.

Figure 2:
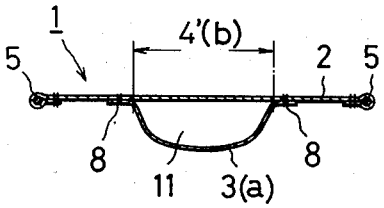
FIGS. 2 to 4, inclusive, are schematic cross-sectional views of several examples of said canvas chute as shown in FIG. 1.
Figure 3:
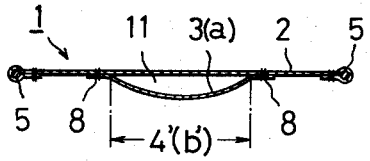
Figure 4:
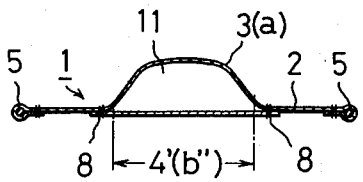

In order to form the tubular zigzag passage 4 having a girth somewhat larger than the maximum circumferential size of men, the passage cloth 3 is attached to the base cloth 2 as shown in FIGS. 2, 3 and 4, in which the width 4' can be varied to change the girth of the passage 4. For example as shown in FIG. 2, the width *b* of the zigzag passage portion 4' is made smaller than the width *a* of the passage cloth 3, that is $b < a$, or as shown in FIG. 3, the width *b'* of the zigzag passage portion 4' is made about the same as the width *a* of the passage cloth 3, or further as shown in FIG. 4, the width *b''* of the zigzag passage portion 4' may be made larger than the width *a* of the passage cloth 3. In these cases, the relation among the widths *b*, *b'* and *b''* holds that $b < b' < b''$.

When a man, i.e. a survivor 10 slips down through the chute 1, in the first place, he steps into the entrance 11 of the zigzag passage 4 within the chute in an upright posture with both legs brought together, while he supports his own body by clinging to a frame portion or the like in said entrance, then he releases his hold in the standing position to fall. Thus he can slip down through the zigzag passage 4 with his legs contacting with the bent portions one by one.

Figure 5:
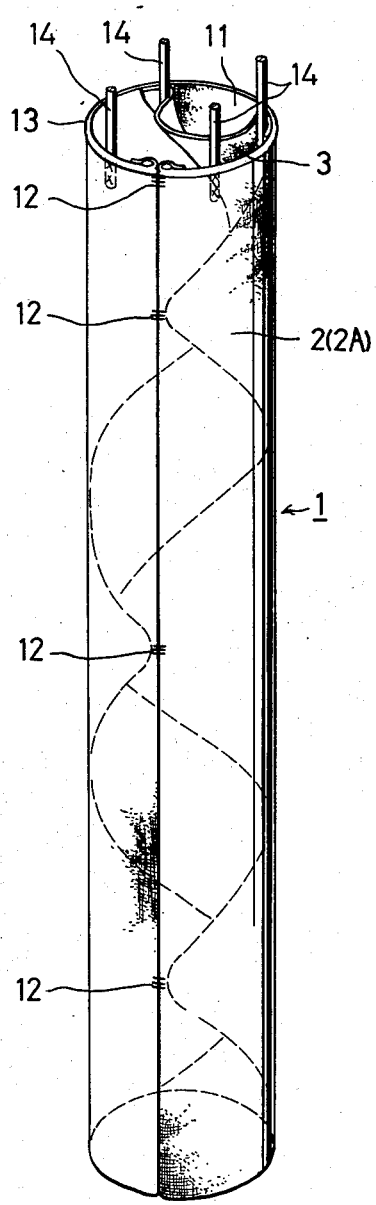
FIG. 5 is a perspective view of the canvas chute as shown in FIG. 1 which is made tubular for the practical use.
Figure 6:
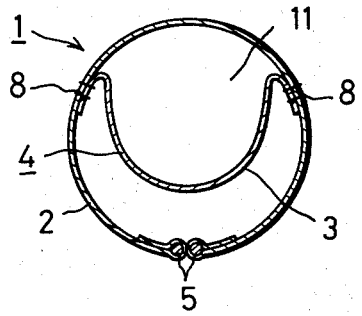
FIG. 6 is a cross-sectional view of the canvas chute as shown in FIG. 5.

In this occasion, the excess deformation of the zigzag passage 4 can be prevented by the reinforcing ropes 5 attached to both sides of the base cloth 2 and the reinforcing ropes 5 are connected together or sewn together along their sides to form a tube of the base cloth (FIG. 5). Accordingly, the circumferential surface of the zigzag passage 4, i.e. the passage cloth 3 evenly contacts the leg portion and body portion of the man 10 regardless of the size of body, and proper frictional resistance is produced to pass him down in a safety velocity.

In the meantime, since the greater part of weight of the body effects to the leg portion of the man 10 in the zigzag passage 4, the passage cloth 3 and base cloth 2 which contacting the leg portion are changed in their configuration as shown by chain lines **4*x* in FIG. 1, which induces the deformation of the passage lower than the portion contacting the legs, and further the upper portion of the passage is somewhat stretched. As will be understood from the shape of the chain line 4*x*, when the designed angle of the bent portion 9 is 60° to the horizontal plane, the actual slipping down angle at the leg portion becomes about 30° to the horizontal plane, so that the body slips down on a very gentle slope and a large braking action is imparted for a short period of time. In this case, the legs contacting the passage cloth 3** is more or less wrapped by the deformed portion, so that the above-mentioned braking effect is still promoted.

As shown in FIG. 5, the reinforcing ropes 5 are connected together at some intervals near the bent portion 9, however, the connections 12 may be made more closely to each other or the base cloth 2 is sewn together along the reinforcing ropes 5 in order to reduce the deformation. If so, the partial deformation of the bent portion 9 is decreased and made even.

Further when the tubular body 2A of the chute 1 which comprising the base cloth 2 and the passage cloth 3 is pulled down by the weight of a man passing through the middle portion of the tubular passage 4, the inside wall of tubular body 2A together with the sewn passage cloth 3 are deformed, so that the inside wall of the body 2A and the side wall of passage cloth 3 contacting the man approach with each other to narrow down the zigzag passage 4 after he passed through, therefore the zigzag passage 4 does not keep its tubular shape. Thereby, frictional effect between the passage cloth 3 and the body of man, especially his leg portion and maximum circumferential portion, is produced, and the slipping down can be effectively braked. In FIG. 5, the numeral 13 indicates a suspending frame being made of rope or metallic material and attached to the upper opening of the tubular body 2A, and the numeral 14 indicates suspending ropes which are connected to some portions of said suspending frame 13 for suspending the chute 1.

Figure 7:
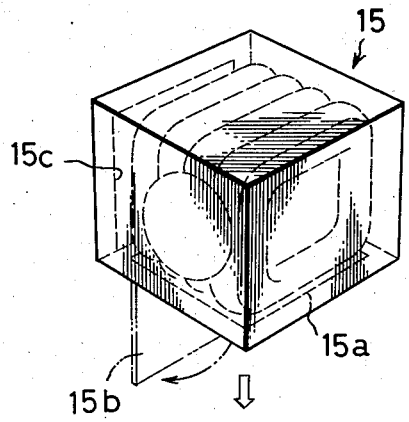
FIG. 7 is a perspective view of a container holding the folded embarking members, the throwing flap of which being opened.

FIG. 7 shows a container 15 of the above-mentioned chute which is folded like an accordion bellows during it is not used, and the flap **15*a* is opened by unlocking in the state as shown by the numeral 15*b*. The folded chute 1 is then drops down from the opened bottom of the container 15 and the upper opening of the chute communicates with the entrance 15*c* of said container 15, thus the survivor opens the door of the entrance 15*c*** and steps into the upper opening of the chute to slip down.

The chute having the above-mentioned simple structure, the survivor can slip down without any danger and trouble by the braking effect just like he goes down a stairway. Further, the zigzag passage 4 is not susceptible to the influences from the outside because the tubular body 2A is made of a base cloth treated with waterproof agent, heat resisting agent and so forth, and the zigzag passage 4 is formed in consideration of the zigzag angle 6, zigzag pitch 7 and the maximum circumferential size of men to slip down, so that it can be used irrespective of sizes of bodies and existence of outfittings. Further, constant and large braking power is effected at each bent portion 9 like the passing of stairway or ladder, so that men can slip down in a constant and safe velocity without causing the difference of slipping velocity due to the variation of height. In addition, according to our tests, this design velocity can be adjusted at about 0.5 m/sec intervals within the range of 1 m/sec to 8 m/sec. Therefore, an embarking device which being convenient and easy to handle can be made.

FIG. 8 is a side view of an embodiment of the present invention in which a slip way is attached between the above-mentioned chute and a platform positioned underneath the chute. Said slip way has a U-shaped section, the depth of which is gradually decreased to the lower portion. The container 15 is placed on the upper deck of a ship S near the broadside, and the lower portion of the chute which is suspended from said container is provided with a platform 18 by way of curtains 16, 16', and a slip way 17.

As shown in FIG. 9, the slip way 17 is attached to the lower end of the chute 1 with an inclination angle $\alpha$ of about 30°, and the depth d thereof is gradually decreased from the connected point with the chute 1. Since the slip way 17 is connected to the chute 1 with the inclination angle $\alpha$, the depth of the slip way 17 at the connected portion becomes substantially larger. So that, the tumbling down of the survivor can be prevented, however, the rest angle of side wall in the lower portion of slip way may be to large if the depth d of the slip way is kept uniform throughout. Accordingly, it is difficult for the survivor to rise up from the lowermost portion of the slip way, which takes much time of slipping down including the time of standing up from the lying down position. Therefor, if the depth *d* of the slip way is uniform, it is inconvenient for passing down a great many persons.

The connecting ropes 19 (generally the extended ends of the above-mentioned reinforcing ropes 5) at the both sides of the lower open end of said slip way 17 are attached to fixtures 20 on the floor surface of the platform 18, and the protective curtain 16 is attached in opposed relation to the open end of the slip way 17 so as to prevent the survivors from jumping out into the sea. While the protective curtain 16' is also attached so as to prevent the waves to come in and the persons to fall out from the platform 18 or to bump against the broadside of the ship. The above-mentioned depth *d* of the slip way in the lower portion can be adjusted by changing the distance between both connecting ropes 19.

By the way, in FIG. 8, the numeral 21 is a protective tube for the vertical chute 1, 22 is a suspending rope for the protective curtain 16 or 16', 23 is a suspending belt for the platform 18, and 24 is a movable frame for the chute 1 and the above-mentioned ropes and belts.

Using the above-mentioned slip way 17, the survivor who slipping down through said chute 1 can be slowed down before he reaches the platform 18, further he can rise up easily and safely without falling down to the outside of the platform 18. Therefore, the device of the present invention can be effectively used in the accident at sea in which safety and rapidity are required for relieving many a person.

The survivors thus slipped down on the platform 18 generally transfer themselves to a life raft beside the platform 18 which raft has been separately thrown down and inblated, however, if needed, the platform 18 itself can be cut apart from the slip way 17.

Figure 12:
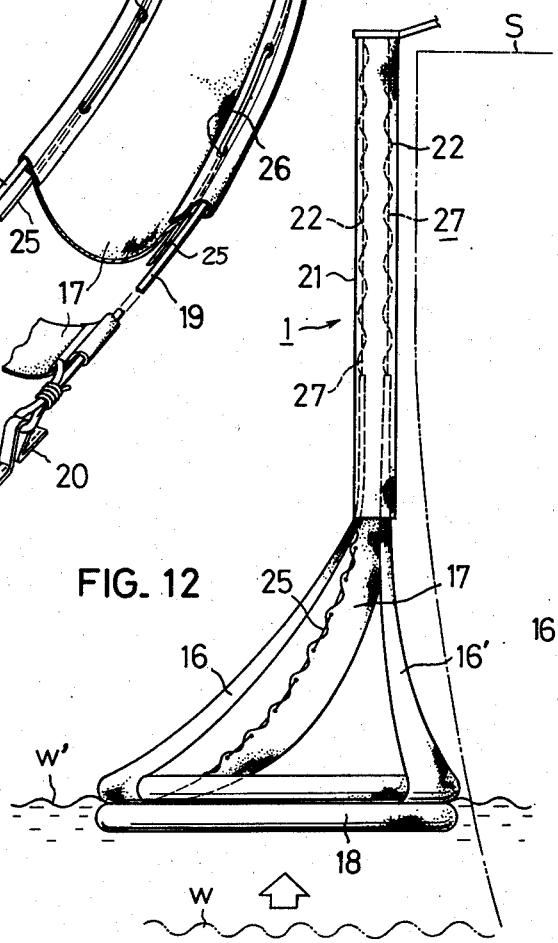

In FIG. 11, another embodiment of slip way 17 is shown, in which elastic ropes 25 are provided through a plurality of eyelets 26 in zigzag way along said connecting ropes 19 on both edge portions of the slip way 17, so that the slip way 17 can be contracted in compliance with the change of level of the platform 18 on the sea surface as shown in FIG. 12. The marks *w* and *w'* indicate the sea surface.

The upper ends of said elastic ropes 25 are fixed to the chute 1 and the lower ends of said ropes 25 are attached to the fixtures 20 on the platform 18. In this case, the effective free length of each elastic rope 25 is almost one half of the distance between the lower end of the chute 1 and the platform 18 when the slip way 17 is inclined at an angle of about 30°, and the extension ratio of said rope 25 is preferably in the range of 280 to 300%.

According to the present invention, when the distance from the deck of the ship to the platform 18 is decreased by the change of sea surface level as shown in FIGS. 11 and 12, the stretched elastic ropes 25 of the slip way 17 is contracted to form a plurality of wrinkles along both edge portions of the slip way 17, thus the whole length of the slip way is reduced and a proper inclination angle is kept to give the safe slipping down.

Figure 13:
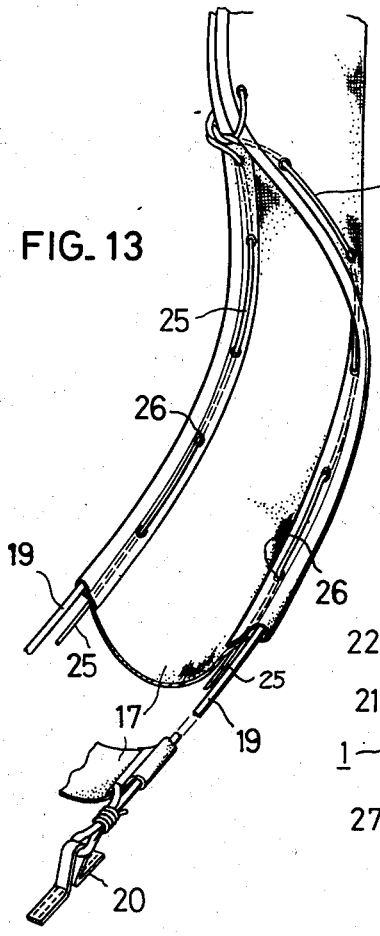
FIG. 13 is a perspective view of the main portion the level regulating section as shown in FIGS. 11 and 12.

FIG. 13 is a perspective view of the main portion of the slip way 17 as shown in FIGS. 11 and 12, which illustrating the attachment of the elastic ropes 25 to the edges of the slip way 17.

The buffer action to the protective curtains 16, 16' of the platform 18 in this case is attained by the suspending ropes 22 and elastic ropes 27 within the protective tube 21 of the chute 1 as shown in FIGS. 11 and 12.

Figure 14:
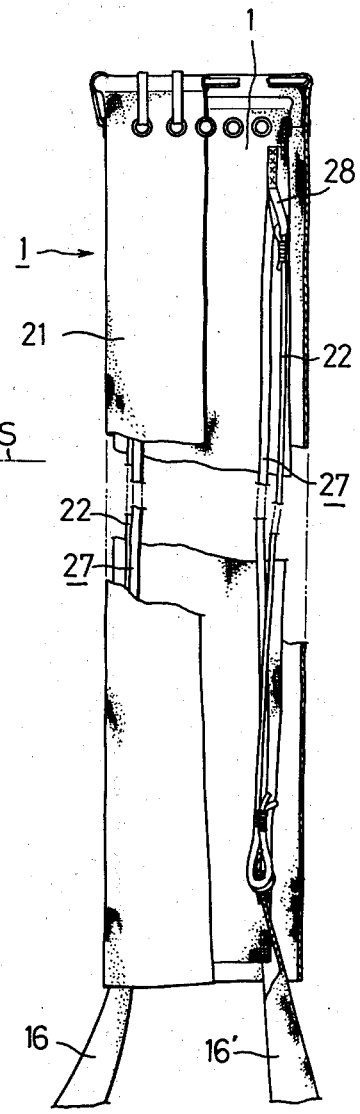
FIG. 14 is an enlarged partial view of the canvas chute as shown in FIGS. 11 and 12.

Further, as shown in FIG. 14, the lower ends of these suspending ropes 22 and elastic ropes 27 are attached to the upper ends of the protective curtains 16, 16' and the upper ends of said ropes 22, 27 are attached by sewing to the fixture rings 28 which being supported between the upper ends of the chute 1 and the protective tube 21. Said suspending ropes 22 are made shorter than the whole length of the chute 1, and the elastic ropes 27 are shorter than said suspending ropes 22, thereby as shown in FIG. 12, when the position of the platform 18 on the waves is raised, the upper ends of the protective curtains 16, 16' are dragged into the space between the chute 1 and the protective tube 21. Though two sets of the suspending ropes 22 and the elastic ropes 27 are shown in the drawing, the number of them may be increased as occasion demands, and the platform 18 is held by some suspending ropes fitted along the chute 1 and the protective curtains 16, 16', which ropes are omitted in the drawings. Accordingly, the lowering and raising of the platform 18 can be carried out automatically without giving any trouble to the chute 1 to attain the safe and rapid embarking operation.

FIG. 15 illustrates another embodiment of the portion as shown in FIG. 13, in which a plurality of loops 29 are attached to the protective ropes 19 along both edges of the slip way 17 at appropriate intervals, and a hook 30 is attached to each fixture 20 on the floor surface of the platform 18 by means of a rope 31 having a proper length. When the loops 29 are caught by said hooks 30 as shown in FIG. 16, the both edges of slip way 17 are shortened as they can be shrunk and the whole length of the slip way 17 is thus reduced, therefore the degree of curve of the slip way 17 can be regulated by selecting the proper loops 29. If desired, the hooks 30 can be attached directly to the eyelets 32 of the loops 29, and further, the other ends of the ropes 31 may be provided with similar hooks 30 so as to be detached from the fixtures 20 on the platform 18.

According to this embodiment, the regulation of the height of the chute 1 in compliance with the change of the freeboard height can be attained by controlling the inclination angle of the slip way 17 in like manner as the embodiment shown in FIG. 12.

FIG. 17 is a plan view of an embodiment of the platform, in which the numerals 23 indicates a suspending belt for the platform 18. Said suspending belt 23 extends on the protective curtains 16, 16', the lower ends of which are attached to the rim tube of platform 18, and the upper ends are attached to the movable frame 24 of the chute 1.

Figure 19:
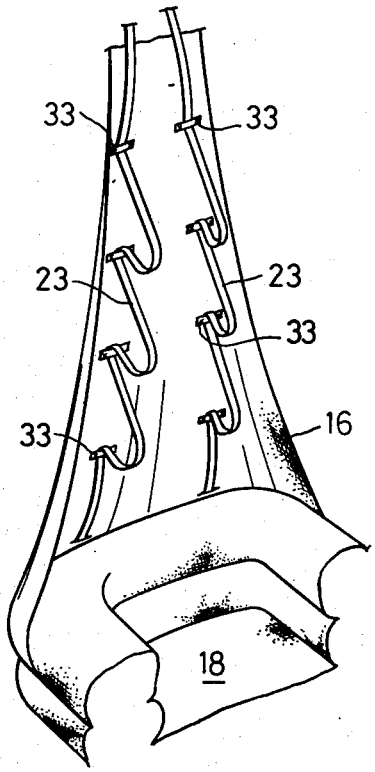
FIG. 19 is a perspective view of the main portion of FIG. 18.
Figure 18:
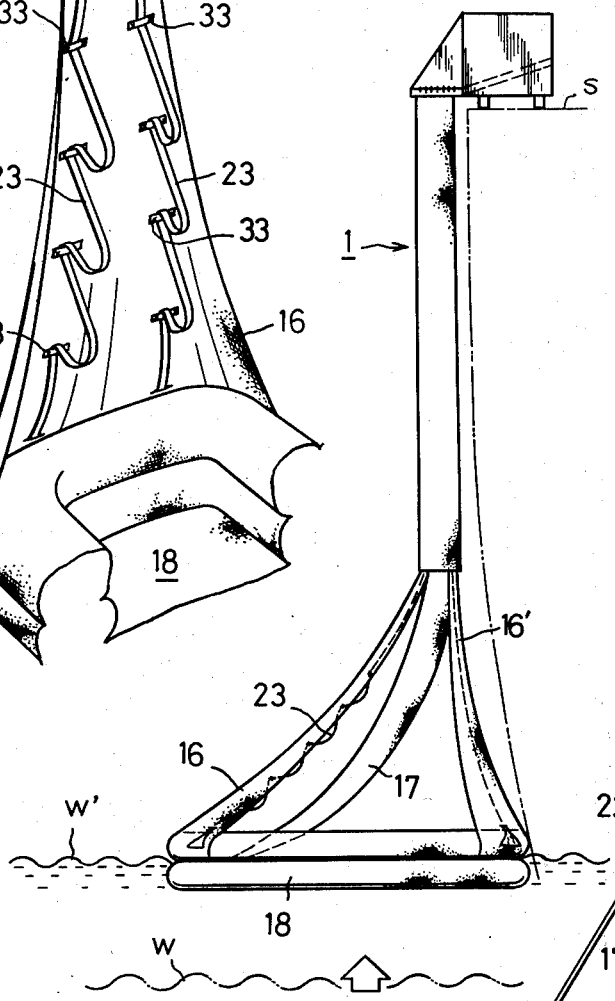
FIG. 18 is an explanatory drawing of suspending belts for the platform which are provided along a protective sheets.

FIGS. 18 and 19 illustrate that the suspending belts 23 of the platform 18 as shown in FIGS. 8 and 17 can be adjusted to the height of the chute 1 and slip way 17 in compliance with the height of freeboard, and the suspending belts 23 on the protective curtain 16 are supported by optional supporting members 33 attached to the inside surface of said curtain 16 with appropriate distances apart. When the level of the platform 18 is changed from the water surface *w* to the upper surface *w'*, the suspending belts 23 stretched through the supporting members 33 on the curtain 16 are hang down by their own weight forming a plurality of pendant loops as shown in FIGS. 18 and 19, therefore the suspending belts 23 can be prevented from largely hanging down to the floor surface of the platform 18. So that, even when the level of platform is raised, the suspending belts 23 do not disturb the persons on the platform 18, and the entanglement of the suspending belts 23 can be prevented during the chute 1 and platform 18 being put back or thrown down. Further, the protective curtains 16, 16' may be made in any shape as far as they cover the platform 18 and being provided with an exit.

Figure 20:
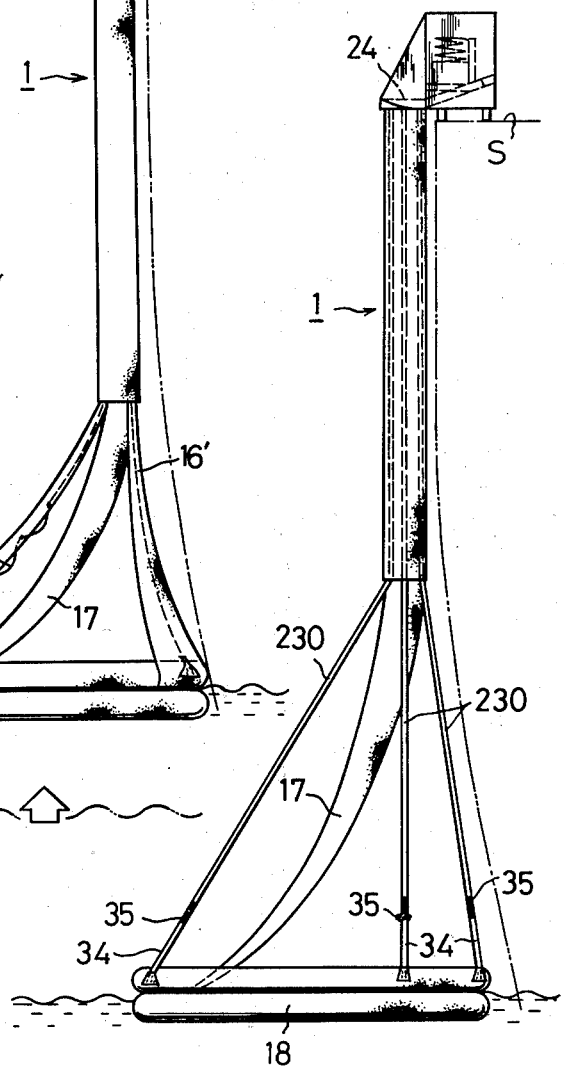
FIG. 20 is a side view of the embarking device where the platform can be detached from the chute.
Figure 21:
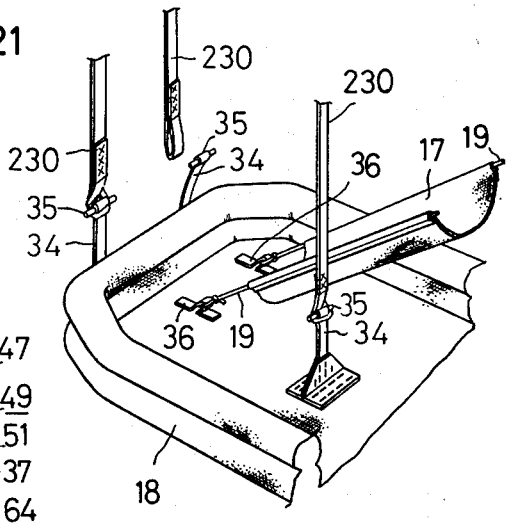
FIG. 21 is a perspective view of the main portion of FIG. 20.

FIGS. 20 and 21 shown still other embodiment of the invention in which the platform 18 can be separated from the chute 1 and the slip way 17. The numerals 230 indicate suspending belts like the above-mentioned belts 23 which extending through the protective tube 21 and attached to a frame 24. The lower ends of said suspending belts 230 are attached to toggles (or hooks) 35 at the upper ends of supporting belts 34 which are fixed to the platform 18, thus said suspending belts 230 can be easily attached and detached. The lower ends of the supporting ropes 19 which are passed through both edges of the slip way 17 are bound to the fixtures 36 on the platform 18, while this attachment of the lower end of the slip way 17 to platform 18 may be made separable by some other measures.

In accordance with this embodiment, since the platform 18 can be separated from the slip way 17, the platform 18 can be used as a life raft as it is, and further, when survivor training is carried out, the handling of the chute 1 and the platform 18 after the training becomes easy.

Figure 22:
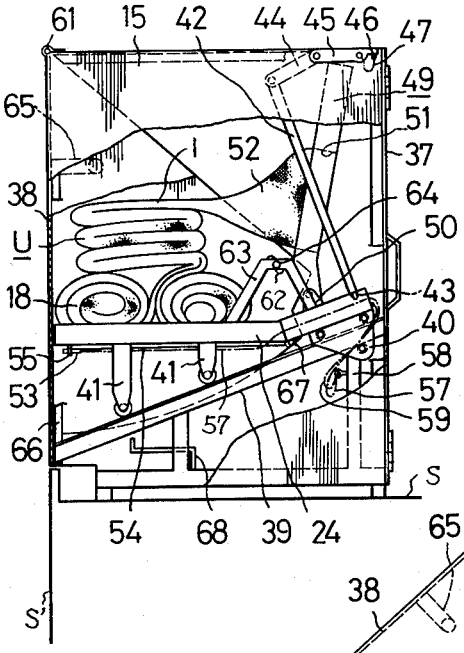
FIG. 22 is a side view of the main portion of an automatic throwing device for the stored embarking members.

FIG. 22 illustrates an automatic throwing device for the embarking device of the present invention, the container 15 of which is placed on the upper deck of the ship S and one side of said container 15 is aligned with the broadside of the ship. In the drawing, the numeral 37 indicates a double-leaf door for the entrance, and 38 indicates a front door which is used for throwing down the embarking members U consisting of the chute 1, protective curtains 16, 16', slip way 17 and platform 18 from the container 15. Further, the numeral 39 is a pair of fixed guide rails which are inclined to the sea surface within said container, 24 is a movable frame for holding said embarking members U and sliding down along said guide rails 39, 40 is a movable bracket having rollers being engaged with the upper and lower surfaces of said guide rail 39 and used for pushing out the movable frame 24 along the rail 39 out of the container 15, and 41 is a roller bracket for horizontally supporting the movable frame 24 on the guide rail 39. Still further, the numeral 42 is a pair of stop bars being provided near the inside surfaces of the container, and the lower ends of said stop bars are releasably inserted to the apertures 43 which are made to both end portions of the movable frame 24. The upper ends of said stop bars are connected to a release lever 45 by way of a link mechanism 44, and said release lever 45 is attached to the inside wall of the container 15. The numeral 46 indicates a safety lock pin which is connected to said release lever 45 by means of a chain 47, and said pin 46 is usually inserted into the aperture 48 on the wall of container 15 so as to prevent the release lever 45 from the movement to the lower direction.

The numeral 49 is a swingable frame for the embarking members U, and the root portion of said frame 49 is swingably pivoted to the right and left brackets 50 of the movable frame 24, further, the opening edge 52 of the chute 1 of said embarking members U is attached to the opening 51 of said swingable frame 49. The numeral 53 indicates a pair of pins for supporting the flap 54 of the movable frame 24, and the tips of said pins are releasably inserted into the apertures 56 of plates 55 attached on the lower surface of the movable frame, while the pins 53 can be pulled out by wires 57 of a certain length. The other end of said wire 57 is fixed to a support frame 58 of the guide rail 39 through the frame of movable bracket 40 on the guide rail 39. Further, another wire 59 is provided between the movable bracket 40 and said support frame 58, and the distance of sliding of the movable bracket 40 can be determined by the length of this wire 59. As shown in FIG. 22, when the movable frame 24 is stored in the container 15, the wires 57 and 59 are slackened and suspended, meanwhile the portion of wire 57 extending under the flap 54 is not rendered slack.

The front door 38 is provided with preferably fan-shaped walls 60 on its right and left sides, so that the door 38 can be opened around the axis 61. A slot 62 is formed on each wall 60 and a boss 64 on a bracket 63 of the movable frame 24 is inserted in said slot 62. By the way, the numeral 65 is a grip bar to which the survivor holds on.

The operation of the above-mentioned device will be explained in the following. In the first place, the pin 46 is pulled out to rotate the release lever 45 in the clockwise direction on the axis, the stop bar 42 is raised by way of the link mechanism 44, thus the engagement with the aperture 43 is released. By this action, the movable frame 24 slides down on the guide rail 39 by its own weight.

Figure 23:
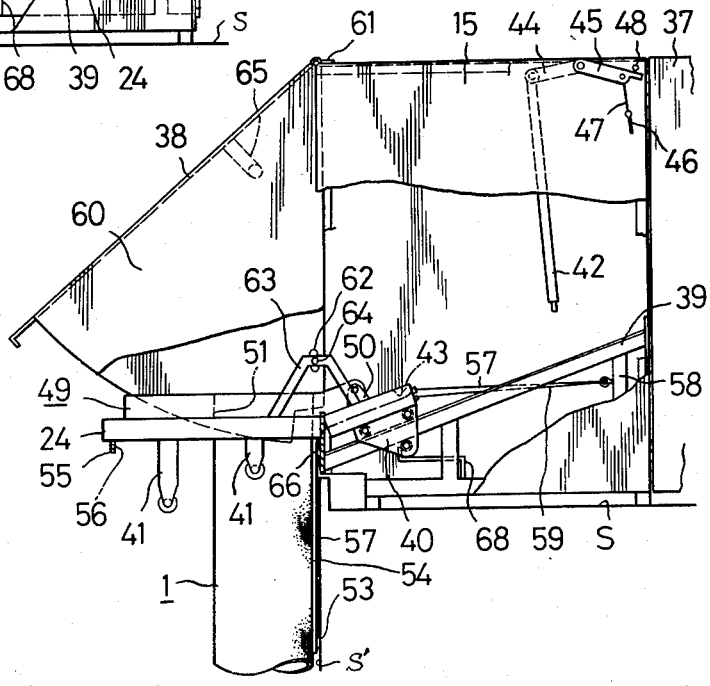
FIG. 23 is an explanatory drawing of the device as shown in FIG. 22.

By this movement, the front door 38 is opened by the pressure of the boss 64 on the bracket 63 as shown in FIG. 23, at the same time, the movable frame 24 moves forwards to the broadside S' together with the embarking members U. This horizontal forward movement of the movable frame 24 is stopped when the front end of movable bracket 40 reaches the stopper frame 66 and the wire 59 is stretched.

When the movable frame 24 is shifted above the broadside accompanying the stretching of the wire 59, the other wire 57 having a predetermined length is also stretched to pull out the support pin 53 for the flap 54 from the aperture 56 of the plate 55. When the pin 53 is pulled off, the flap 54 swings down on the axis 67 to open the floor surface of the movable frame 24. thereby the embarking members U fall down along the broadside of the ship.

By this falling load, the swingable frame 49 is swung down on the movable frame 24 in layers, thus the opening 51 aligns with the upper opening of the chute 1, and the hand grip bar 65 comes out above said opening 51, which grip bar assists the stepping into the chute 1.

The embarking members U are suspended in order of the chute 1, protective curtains 16, 16', and inflatable platform 18, and simultaneously with the falling down of the members U, the platform 18 is supplied with carbon dioxide gas from a gas cylinder (not shown), so that when the platform 18 reaches the sea surface, it is almost completely inflated.

Since the embarking members U can be thrown down only by operating the release lever 37, the survivor can promptly step into the opening 51 from the entrance door 37 and slips into the chute 1 in the standing posture. After the survivors slipped down on the platform 18, they may transfer to another life raft which has been separately thrown down and inflated, and drift away thereby. Since the above-mentioned front door 38 intercepts the circumferential scenes in this occasion, the survivor are not seized with fear.

Further, in order to make the embarking action easy, steps 68 and 69 are provided to the lower front portion of the container 15, and as shown in FIG. 24, the step 69 is positioned side by side with another step 68 when the movable bracket 40 is projected, so that persons can get in the opening 51 by way of two steps without difficulty.

Figure 27:
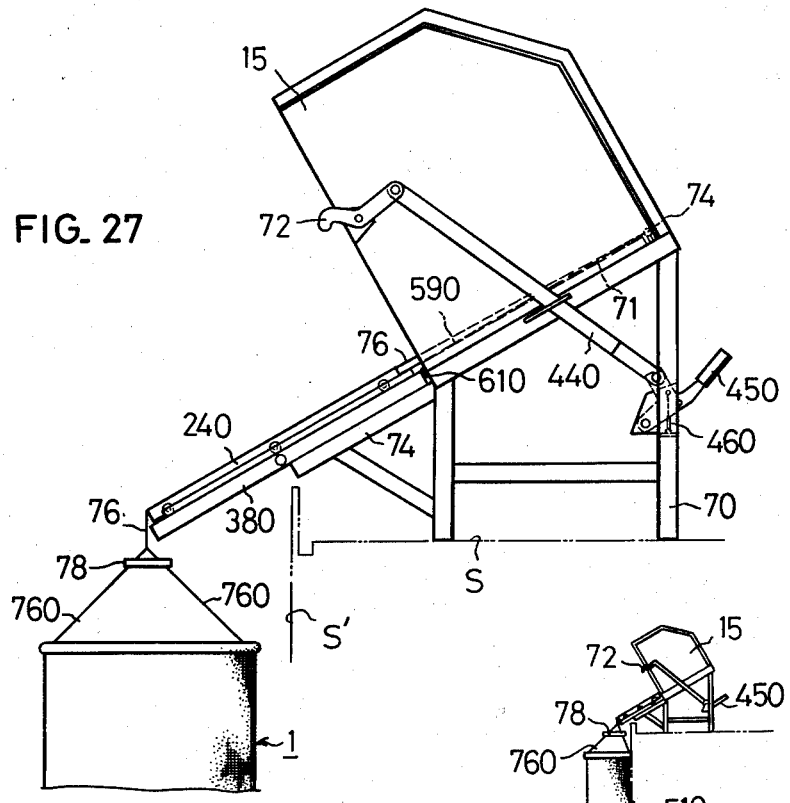
FIG. 27 is a side view of the device as shown in FIG. 25 in which the embarking members has been thrown down.

FIG. 25 illustrates another embodiment of the device as shown in FIG. 22, in which the container 15 is supported on the legs 70 by the broadside of the ship S in like manner as the foregoing embodiment, and the bottom 71 of the container is inclined in order that the front door 380 may face downwards. When a release lever 450 is pulled to this side (rightward on the drawing), the pins 73 on both sides of the door 380 are released from the hooks 72 through the link mechanisms 440, thereby the front door 380 can be opened on the axis 610 and rests on a support 74 as shown in FIG. 27. The inside surface of said front door 380 is provided with a movable frame 240 which is used for supporting the embarking members U, and between this movable frame 240 and the bottom surface 71 of the container 15, some rollers are provided, so that, when the front door 380 is opened, the movable frame 240 is caused to slide down and project as far as the wire 590 permits.

Figure 28:
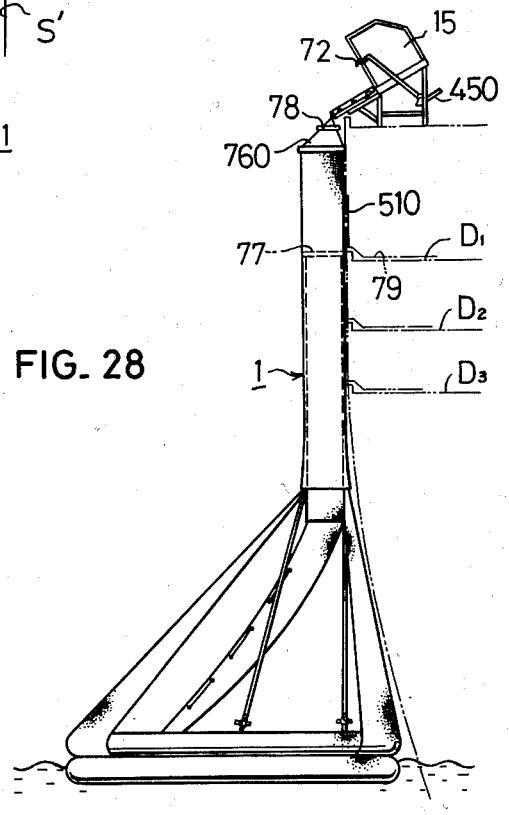
FIG. 28 is an explanatory drawing of the thrown chute and the entrance for embarkation.

Said wire 590 is fixed to a hook 75 on the container 15 and another wire 76 for suspending the embarking members U is also fixed to said hook 75, thus as shown in FIGS. 27 and 28, the embarking members U such as the chute 1, protective curtains 16, 16', and platform 18 are suspended from the front door 380 along the broadside S' when the front door 380 is opened.

In this occasion, the platform 18 is inflated with carbon dioxide from a gas cylinder during it is dropping. The operation of the release lever 450 is carried out by pulling off the safety lock pin 460 from the pin hole, and this operation to open the above mentioned front doors 38 and 380 of a plurality of containers 15 can be simultaneously carried out by remote control from an instruction chamber.

In accordance with the scale of the ship necessary number of the embarking devices of the present invention may be installed, and each of the suspended chutes along the broadside may be provided with each exclusive entrance 510 corresponding to each deck $D_1$, $D_2$ or $D_3$. So that, the chute 1 receives the passengers from only one deck so as not to fall across the passengers from the other decks. The numeral 77 is a support frame for the chute 1 in the portion of the entrance 510, and the numeral 78 is a keep plate for equalizing the loads which are caused to the chute suspending wires 760.

Figure 29:
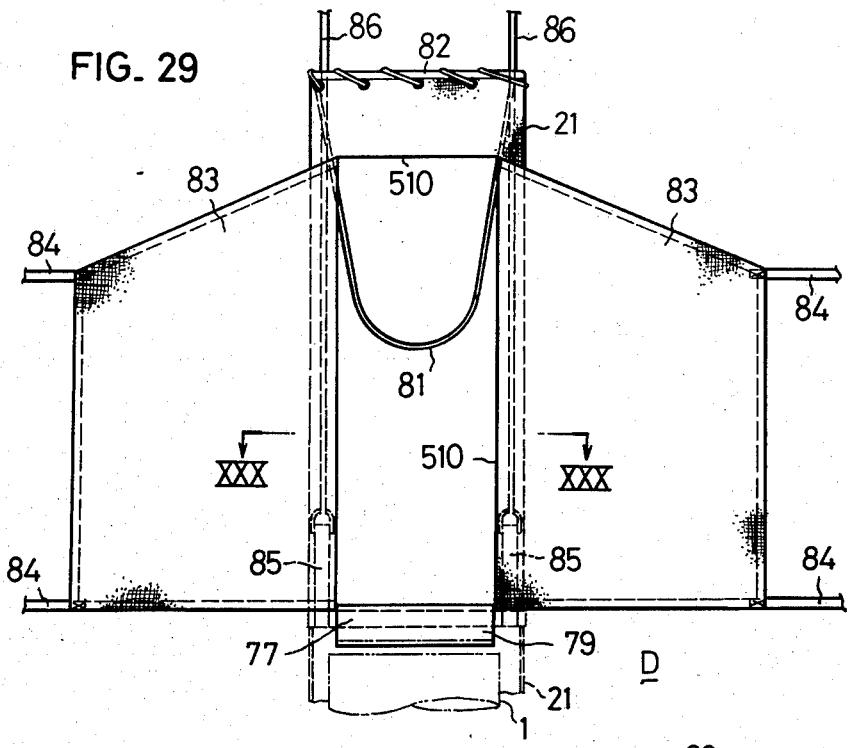
FIG. 29 is an explanatory drawing illustrating the structure of the entrance portion.
Figure 30:
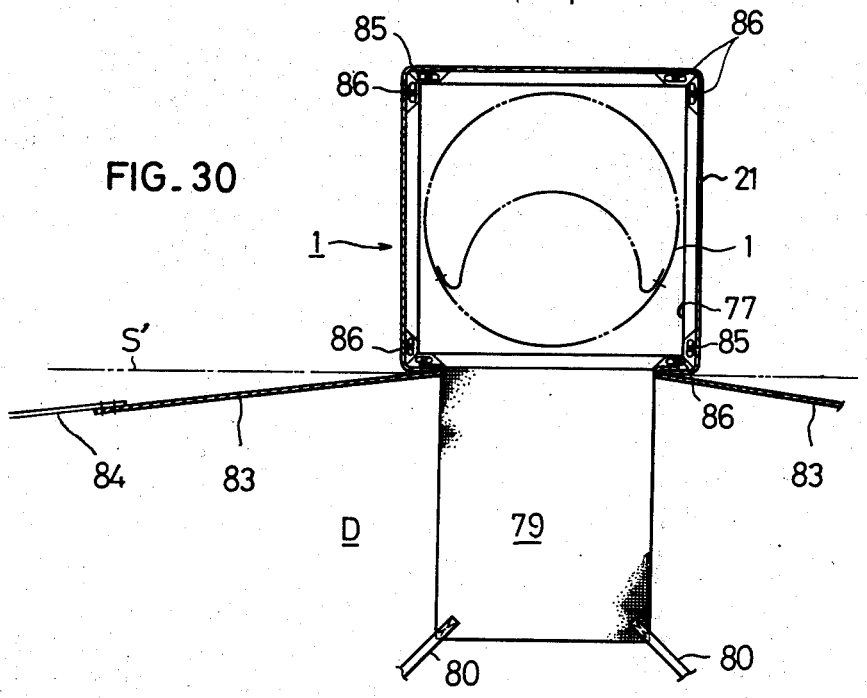
FIG. 30 is a sectional view taken along the line XXX—XXX in FIG. 29.

FIG. 29 illustrates the structure of the above-mentioned entrance 510, and as shown in this figure, said entrance 510 is shaped in a rectangular form and provided on one side of the protective tube 21 at the corresponding height to one deck D, and the lower edge of said entrance 510 is provided with a footcloth 79. Referring to FIG. 30, said footcloth 79 is fixed by fixture belts 80. A strap 81 is suspended from a support frame 82 of the protective tube 21, which strap is used when the survivors slide down. Both sides of the entrance 510 are provided with blind cloths 83, and one side edge of each cloth 83 is sewn up with the side of said entrance 510 and the other edge of said cloth 83 is connected to some support such as the handrail on the deck by means of fixture belts 84. The numeral 77 is also a support frame which is fitted within the protective tube 21 at the lower edge of the entrance 510, in this case the chute 1 is suspended under the support frame and the numeral 85 is a connecting belt between said support frame 77 and the suspending wire 86.

FIG. 30 is a horizontal sectional view of the entrance portion of the chute 1 taken along the line XXX—XXX in FIG. 29, in which the mark S' indicates the broadside of the ship. After the chute 1 is thrown down, said blind cloths 83 are opened to right and left from the portion of entrance 510, and the fixture belts 84 are attached to the handrail or deck. Thus spread blind cloths 83 on both sides of the entrance 510 facilitate to guide the survivors to said entrance and relieve their fear.

Figure 31:
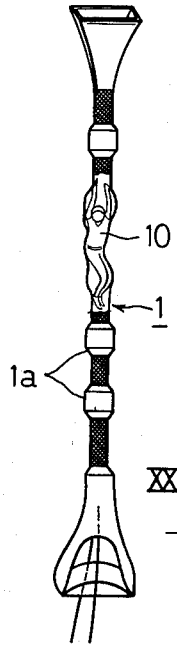
FIG. 31 is an explanatory perspective view of another embodiment of the chute.
Figure 32:
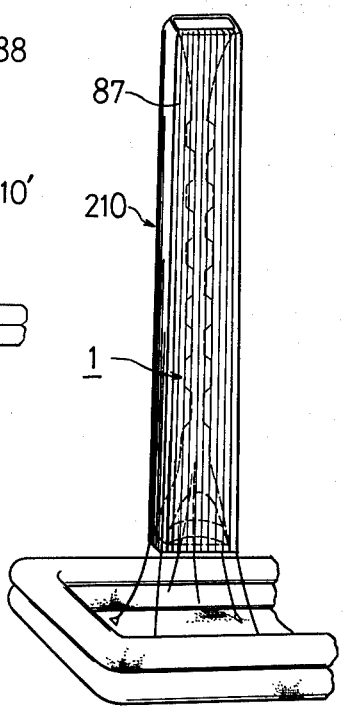

FIG. 31 illustrates another embodiment of the chute 1, in which a survivor 10 who is slipping down in shown. This chute 1 is provided with a plurality of expanded portion 1*a*, and as shown in FIG. 32, the chute 1 is covered by a protective tube 210 which comprising a large number of longitudinal gas columns 87, therefore, when the chute 1 is rocked, the chute 1 is prevented from bumping directly upon the broadside. In this embodiment, the protective tube 210 is inflated by carbon dioxide gas from a gas cylinder during it is thrown down, and the chute 1 and the survivors are protected by this protective tube 210.

Figure 33:
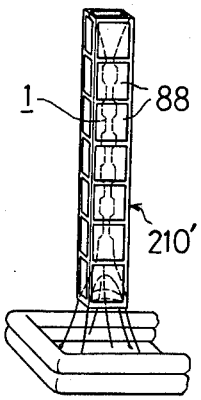
FIG. 32 and FIG. 33 are perspective views of other embodiments of the guard sheets for the chutes.

FIG. 33 illustrates another embodiment of the protective tube 210 as shown in FIG. 32, in which the protective tube 210' is provided with a plurality of foamed plastic plates or plywood plates 88 on the circumferential surface, thus the chute 1 and the survivors in the chute can be protected in like manner as the foregoing embodiment.

Figure 34:
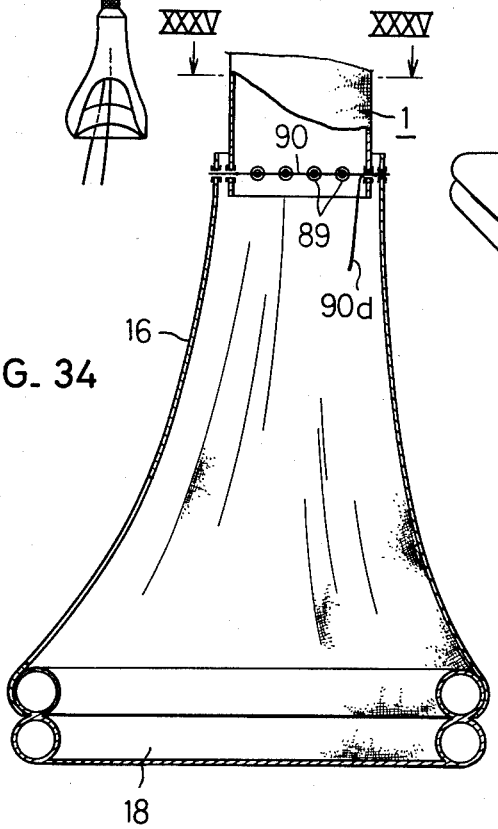
FIG. 34 is an explanatory drawing of the attachment between the chute and guard sheet.
Figure 35:
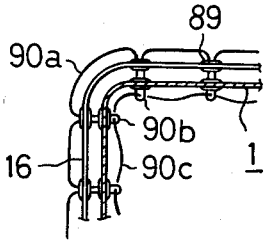
FIG. 35 is a fragmentary cross-sectional view taken along the line XXXV—XXXV in FIG. 34.

FIG. 34 illustrates the interconnection between the chute 1 and the protective curtain 16, where appropriate number of eyelets 89 are fitted to the lower end of the chute 1 and to the upper end of the curtain 16, and a string 90 is inserted through said eyelets 89. As shown in FIG. 35, the inner string 90*c* is passed through the loops 90*b* of the string 90*a*, and the inner string 90*c* can be taken away from the loops 90*b* by pulling the end portion 90*d* of the inner string 90*c*. Therefore, the survivors on the platform 18 can easily drift away from the chute 1 by pulling the end portion 9*d* of the inner string 90*c*.

For the above-mentioned strings, a slide fastener can be substituted, and any other means may also be used so long as it is able to separate the platform from the chute 1.

As disclosed in the above, the survivor from a passenger-carrying vessel through the chute 1 can be carried out safely and rapidly by using the embarking device of the present invention, and the velocity of slipping down can be equalized and decreased by the zigzag passage irrespective of the sizes of persons, therefore the safe embarkation and several other advantages as stated in the above can be expected.

The slip down way embarking device of the present invention can be used not only for the ships but also for the high-storied buildings. It should be emphasized, however, that the specific embodiments described and shown herein are intended as merely illustrative and in no way restrictive of the invention.

What is claimed is:

1. A slip-down way embarking device comprising a slip-down chute comprising an elongated base cloth having opposite edges, at least one reinforcing rope longitudinally secured to one of said opposite edges of said base cloth and extending the length thereof, a passage cloth secured to said base cloth, securing means for securing said passage cloth to said base cloth to define a passageway between a portion of said base cloth having a first width and a portion of said passage cloth having a second width, said first and second widths being of unequal dimensions, said passageway being in the shape of a zigzag having at least one bent portion, said bent portion being secured to said base cloth adjacent said reinforcing rope whereby said reinforcing rope is operative to restrain said passageway from stretching and deforming under force of an object passing therethrough.

2. The device of claim 1 comprising two reinforcing ropes longitudinally secured to each said opposite edges of said base cloth and extending the length thereof, said passageway having at least two bent portions, each said bent portion being secured to said base cloth adjacent one of said reinforcing ropes whereby said reinforcing ropes are operative to restrain said passageway from stretching and deforming under force of an object passing therethrough.

3. The device of claim 1 wherein said opposite edges of said base cloth are secured to each other along the length thereof, said base cloth thus defining a tube with said passageway disposed inside said tube.

4. The device of claim 1 wherein said base cloth is constructed of material chosen from the group consisting of natural fiber cloth and synthetic fiber cloth treated with a waterproofing agent.

5. The device of claim 1 wherein said zigzag passageway is formed with zigzag angles of from 50° to 70° to the horizontal plane.

6. The device of claim 1 wherein each said bent portion disposed adjacent one of said reinforcing ropes has a radius of curvature smaller than the width of said passageway.

7. The device of claim 1 wherein said chute is adapted to be hung from a vehicle and further comprising a floating platform disposed under said chute and a slip way between said chute and said platform.

8. The device of claim 7 comprising means for regulating the length of said slip way with changes in the level of said platform relative to said chute.

9. The device of claim 7 wherein said slip way has an upwardly disposed substantially U-shaped cross-section, the depth of said slip way being greater at the upper portion than at the lower portion thereof, said depth gradually decreasing from said upper portion to said lower portion.

10. The device of claim 1 wherein said chute is adapted to be hung from a vehicle and comprises an entrance for slipping down including a foot cloth and a blind cloth on right and left sides of said entrance.

11. A slip-down way embarking device comprising a slip-down chute adapted to be hung from a vehicle, a floating platform disposed under said chute, a slip way between said chute and said platform, and means to adjust the length of said slip way with changes in the level of said platform relative to said chute, further comprising a first protective curtain attached to the front portion of the open side of said slip way between said chute and said platform, said first curtain being arranged to prevent survivors from jumping out of said slip way, and a second curtain attached in opposite relationship to said first curtain, said curtains defining an open space between said curtains to permit survivors to board a life raft from said platform through said open space.

12. The device of claim 11 wherein said slip way has an upwardly disposed substantially U-shaped cross-section, the depth of said slip way being greater at the upper portion than at the lower portion thereof, said depth gradually decreasing from said upper portion to said lower portion.

13. The device of claim 11 further comprising means to absorb slack in said curtains resulting from changes in the level of said platform relative to said chute.

14. The device of claim 13 wherein said means to absorb slack in said curtains comprises elastic suspending ropes attached to the upper ends of said curtains.

15. The device of claim 11 comprising suspending belts for suspending said platform, the upper ends of said belts being attached to the upper portion of said chute, the lower ends of said belts being attached to said platform and said belts being supported by a plurality of supporting means on said curtains, whereby slack in said suspending belts is absorbed during changes in the level of said platform relative to said chute.

16. The device of claim 15 wherein said platform is releasably attached to said belts and said chute whereby said platform can be used upon release therefrom as a life raft.

17. The device of claim 11 further comprising a container for said device, said device being adapted to be stored in said container and means for automatically projecting said device from said container when ready for use.

18. The device of claim 11 wherein said chute comprises an elongated base cloth having opposite edges, at least one reinforcing rope longitudinally secured to one of said opposite edges of said base cloth and extending the length thereof, a passage cloth secured to said base cloth, securing means for securing said passage cloth to said base cloth to define a passageway between said base cloth and said passage cloth, said passageway being in the shape of a zigzag having at least one bent portion, said bent portion being secured to said base cloth adjacent said reinforcing rope whereby said reinforcing rope is operative to restrain said passageway from stretching and deforming under force of an object passing therethrough.

19. The device of claim 18 comprising two reinforcing ropes longitudinally secured to each said opposite edges of said base cloth and extending the length thereof, said passageway having at least two bent portions, each said bent portion being secured to said base cloth adjacent one of said reinforcing ropes whereby said reinforcing ropes are operative to restrain said passageway from stretching and deforming under force of an object passing therethrough.

20. The device of claim 18 wherein said opposite edges of said base cloth are secured to each other along the length thereof, said base cloth thus defining a tube with said passageway disposed inside said tube.

21. A slip-down way embarking device comprising a slip-down chute adapted to be hung from a vehicle, a floating platform disposed under said chute, a slip way between said chute and said platform, and means to adjust the length of said slip way with changes in the level of said platform relative to said chute, said means to adjust the length of said slip way comprising elastic ropes secured along opposite edges of said slip way.

22. The device of claim 21 further comprising a container for said chute, a movable frame, and locking means, said frame being adapted to be projected from a side of said container by releasing said locking means, releasing means adapted to drop down said chute on said movable frame by projection of said movable frame and means for automatically throwing down said chute to a desired location upon projection of said movable frame, said movable frame being constructed and arranged to form an entrance to said chute.

23. The device of claim 21 further comprising a container for storing said chute, said container having a front door including locking means for locking said door, said container including means to install said container in a direction inclined from the deck of a vehicle, said locking means being operative to release said front door and means to automatically project said chutes from said container upon release of said locking means and opening of said door.

24. A slip-down way embarking device comprising a slip-down chute adapted to be hung from a vehicle, a floating platform disposed under said chute, a slip way between said chute and said platform, and means to adjust the length of said slip way with changes in the level of said platform relative to said chute, wherein said means to adjust the length of said slip way comprises at least two loops secured in spaced relationship along opposite edges of said slip way and said platform includes hooks secured thereto whereby the length of said slip way can be regulated by engagement of said hooks and said loops.

25. The device of claim 24 further comprising a container for said chute, a movable frame, and locking means, said frame being adapted to be projected from a side of said container by releasing said locking means, releasing means adapted to drop down said chute on said movable frame by projection of said movable frame and means for automatically throwing down said chute to a desired location upon projection of said movable frame, said movable frame being constructed and arranged to form an entrance to said chute.

26. The device of claim 24 further comprising a container for storing said chute, said container having a front door including locking means for locking said container, said container including means to install said container in a direction inclined from the deck of a vehicle, said locking means being operative to release said front door and means to automatically project said chutes from said container upon release of said locking means and opening of said door.

* * * * *

UNITED STATES PATENT OFFICE

CERTIFICATE OF CORRECTION

Patent No. 3,994,366 Dated November 30, 1976

Inventor(s) Masahiro Okuma, Mutuo Sato, Matuo Narita, Toshio Sugimoto, Masahumi Isihara and Hisanao Yagi It is certified that error appears in the above-identified patent and that said Letters Patent are hereby corrected as shown below:

Column 3, line 14, before "portion" insert -- bent --.

Column 7, line 42, delete "shown" and substitute therefor -- show --.

Column 10, line 29, after "82" insert -- of the upper edge --.

Column 11, line 11, delete "9d" and substitute therefor -- 90d --

Signed and Sealed this

Nineteenth Day of April 1977

[SEAL]

*Attest:*

RUTH C. MASON
*Attesting Officer*

C. MARSHALL DANN
*Commissioner of Patents and Trademarks*